US010647149B2

(12) United States Patent
Reynolds

(10) Patent No.: US 10,647,149 B2
(45) Date of Patent: May 12, 2020

(54) STATIONERY SECURING APPARATUS AND INSTRUMENT HOLDER

(71) Applicant: Donald James Reynolds, Victoria, MN (US)

(72) Inventor: Donald James Reynolds, Victoria, MN (US)

( * ) Notice: Subject to any disclaimer, the term of this patent is extended or adjusted under 35 U.S.C. 154(b) by 84 days.

(21) Appl. No.: 15/910,172

(22) Filed: Mar. 2, 2018

(65) Prior Publication Data

US 2018/0250978 A1 Sep. 6, 2018

Related U.S. Application Data

(60) Provisional application No. 62/466,639, filed on Mar. 3, 2017.

(51) Int. Cl.

| | |
|---|---|
| ***B43K 23/00*** | (2006.01) |
| ***A44B 17/00*** | (2006.01) |
| ***A44B 18/00*** | (2006.01) |
| ***B42D 17/00*** | (2006.01) |
| ***B65D 63/10*** | (2006.01) |
| ***B42D 3/12*** | (2006.01) |
| *B42D 9/00* | (2006.01) |

(52) U.S. Cl.

CPC ..... *B43K 23/001* (2013.01); *A44B 17/0041* (2013.01); *A44B 17/0082* (2013.01); *A44B 18/00* (2013.01); *B42D 3/12* (2013.01); *B42D 17/00* (2013.01); *B65D 63/109* (2013.01); *A44D 2211/00* (2013.01); *B42D 9/007* (2013.01); *B42P 2241/04* (2013.01); *B42P 2241/18* (2013.01); *B65D 2563/107* (2013.01); *B65D 2563/108* (2013.01)

(58) Field of Classification Search

CPC ..... Y10T 24/1332; Y10T 24/1397; Y10T 24/314; Y10T 24/316; Y10T 24/2708; Y10T 24/1368; B43K 23/00; B43K 23/001; B42D 3/12; B42D 17/00; B42D 9/007; A44B 17/0082; A44B 18/00; A44B 17/0041; B65D 63/109; B65D 2563/108; B65D 2563/107; B42P 2241/18; B42P 2241/04; A44D 2211/00

See application file for complete search history.

(56) References Cited

U.S. PATENT DOCUMENTS

| | | | |
|---|---|---|---|
| 417,942 | A | 12/1889 | Raffel |
| 433,938 | A | 8/1890 | Gleeson |

(Continued)

FOREIGN PATENT DOCUMENTS

| | | |
|---|---|---|
| CA | 2878532 | 4/2017 |
| CH | 89101 | 4/1921 |

(Continued)

*Primary Examiner* — Robert Sandy

(74) *Attorney, Agent, or Firm* — Vidas Arrett & Steinkraus P.A.

(57) ABSTRACT

A stationery securing apparatus and writing instrument holder is provided with a band, at least a portion of which is elastic. At least two writing instrument loops are attached to the elastic band, and a male snap portion and a female snap portion attached to the band, configured and arranged so that when the band is not in use securing stationery, it can be folded or rolled up and the male snap portion and the female snap portion can be snapped together to form a compact writing instrument holder.

21 Claims, 19 Drawing Sheets

(56) References Cited

U.S. PATENT DOCUMENTS

| | | | | | |
|---|---|---|---|---|---|
| 738,462 | A | | 9/1903 | Lincoln | |
| 1,482,647 | A | * | 2/1924 | Gise | A45F 5/00 24/3.2 |
| 1,484,321 | A | | 2/1924 | Brouillette et al. | |
| 1,603,044 | A | * | 10/1926 | Gise | A44C 5/0046 224/221 |
| 2,704,077 | A | | 3/1955 | Prillaman | |
| 3,577,604 | A | | 5/1971 | Brosk | |
| 3,823,814 | A | | 7/1974 | Lum | |
| 4,133,080 | A | | 1/1979 | Kuk | |
| 4,162,800 | A | | 7/1979 | Gonot, Jr. et al. | |
| 5,016,559 | A | | 5/1991 | Larson et al. | |
| 5,154,506 | A | * | 10/1992 | Leard | F21L 15/14 224/222 |
| 5,446,953 | A | | 9/1995 | LeFeber | |
| 5,456,497 | A | | 10/1995 | Ross, Jr. | |
| 5,636,868 | A | | 6/1997 | Ross, Jr. | |
| 5,881,434 | A | | 3/1999 | Rigney | |
| 6,481,367 | B2 | | 11/2002 | McClosky | |
| 7,562,636 | B2 | * | 7/2009 | Regala | B42D 9/004 116/234 |
| 2008/0314773 | A1 | | 12/2008 | Dragonheart | |
| 2011/0305496 | A1 | * | 12/2011 | Jolani | B43K 23/001 401/6 |
| 2013/0049345 | A1 | | 2/2013 | Imbernino | |
| 2014/0263496 | A1 | | 9/2014 | Zimmerman et al. | |
| 2015/0037081 | A1 | * | 2/2015 | Sutton | B43K 23/001 401/8 |

FOREIGN PATENT DOCUMENTS

| | | |
|---|---|---|
| DE | 20 2016 103 313 U1 | 11/2016 |
| WO | 2007/023275 A1 | 3/2007 |

* cited by examiner

STATIONERY SECURING APPARATUS AND INSTRUMENT HOLDER

CROSS-REFERENCE TO RELATED APPLICATIONS

This application claims priority to 62/466,639, filed Mar. 3, 2017, the entire contents of which are hereby incorporated by reference.

STATEMENT REGARDING FEDERALLY SPONSORED RESEARCH

Not Applicable

FIELD OF THE INVENTION

The invention relates to a stationery securing apparatus and writing instrument holder, which can also be wrapped around and attached to itself to hold writing implements.

BACKGROUND OF THE INVENTION

Many different stationery securing device have been invented. See the table below which lists them:

| Patent No. | Date | Title |
|---|---|---|
| 417,942 | Dec. 24, 1889 | Combined book strap and Scholar's companion |
| 433,938 | Aug. 12, 1890 | Pencil Holder |
| 738,462 | Sep. 8, 1903 | Combined Book Carrier and Scholar's Companion |
| 1,484,321 | Feb. 19, 1924 | Combined Paper and Pencil Holder |
| 2,704,077 | Sep. 10, 1953 | Pen and Pencil Holder |
| 3,577,604 | May 4, 1971 | Writing Implement Holder for books or Like Articles |
| 3,823,814 | Jul. 16, 1974 | Apparatus for Attaching Objects to each other |
| 4,133,080 | Jan. 9, 1979 | Textbook Holder |
| 4,162,800 | Jul. 31, 1979 | Combination Bookmark and Writing Instrument Holder |
| 5,016,559 | May 21, 1991 | Bookmark Having Integral Pencil Holder |
| 5,446,953 | Sep. 5, 1995 | Elastic Apparatus for Restraining Articles |
| 5,456,497 | Oct. 10, 1995 | Apparatus for Holding Reading Material Binder |
| 5,636,868 | Jun. 10, 1997 | Apparatus for Holding Reading Material Binder |
| 5,881,434 | Mar. 16, 1999 | Implement Holder |
| 6,481,367 | Nov. 19, 2002 | Combination Pen Holder and bookmark/Placesaver |
| 7,562,636 | Jul. 21, 2009 | Writing Instrument Holder and Bookmark |
| US 2008/0314773 | Dec. 25, 2008 | Highlighter Holder to Marketed as "Marker Mate" |
| US 2013/0049345 | Feb. 28, 2013 | Pen or Pencil Holder for Notebook, Planner or Binder Cover Panel |
| US 2014/0263496 | Sep. 18, 2014 | Holder for Writing Instruments |
| WO 2007/023275 | Mar. 1, 2007 | A Holder |
| DE 202016103313 U1 | Nov. 24, 2016 | In German |
| CH 89101 | Apr. 16, 1921 | Not sure - Switzerland |
| CA 02878532 | Dec. 14, 2016 | Book with writing instrument storage space |

BRIEF SUMMARY OF THE INVENTION

What is needed is a stationery holder which can also hold writing implements and also forms a compact portable writing instrument holder. A stationery securing apparatus and writing instrument holder is provided with a band, at least a portion of which is elastic. At least two writing instrument loops are attached to the elastic band, and a male snap portion and a female snap portion attached to the band, configured and arranged so that when the band is not in use securing stationery, it can be folded or rolled up and the male snap portion and the female snap portion can be snapped together to form a compact writing instrument holder.

Stationery securing apparatus and instrument holder used to keep stationery items organized and together; easily attaches and detaches; when not in use as securing apparatus (as in FIG. 1), it easily transforms into a compact portable pen/instrument holder (FIG. 2).

This apparatus is easily customizable, compact, modular and provides unique multiuse features and benefits than any other: bookmark, journal band or pen holder available today.

The methods used to fold or roll apparatus and then secure it to itself transforming it from a robust journal band to a compact portable pen holder are unique to this invention. Various lengths, widths, materials and techniques may be used in its construction; it is the combinations of compact, multipurpose, ease of modular attachability and prominent display locations that are unique to this invention.

Modular attachments may include but are not limited to: name labels, brands, icons, logos, additional organizational tools (such as pockets) and/or miscellaneous decorative embellishments.

BRIEF DESCRIPTION OF THE DRAWINGS

FIG. 32 shows a clear plastic case the inventive journal band can be packaged in or shipped in.

FIG. 44 shows the button hole the button is fastened to.

DETAILED DESCRIPTION OF THE INVENTION

Figure 1B:
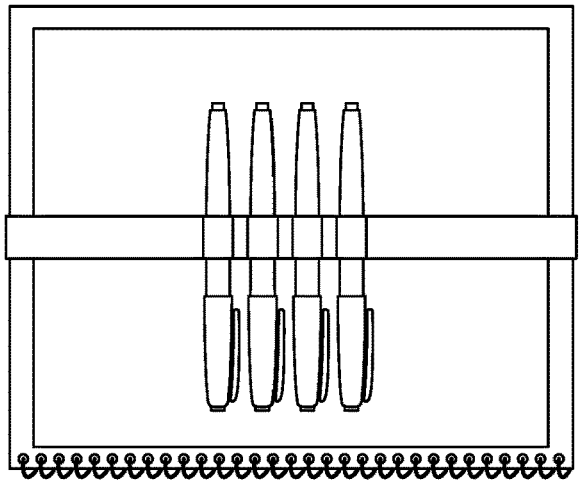
FIG. 1*b* is a front view showing an embodiment of the invention with the journal band in a vertical orientation.

While this invention may be embodied in many forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 1A:
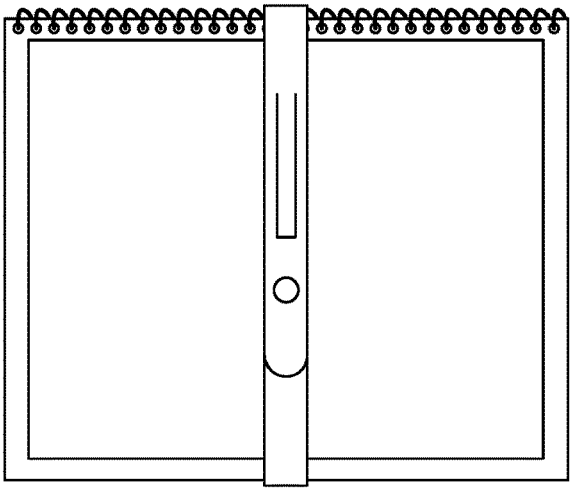
FIG. 1*a* is a back view of the embodiment of FIG. 1.
Figure 1:
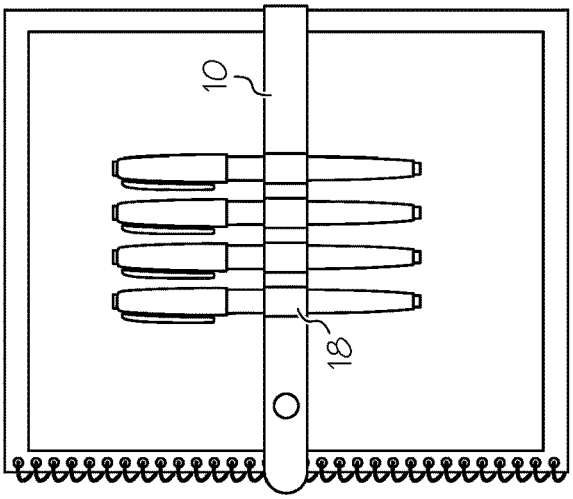
FIG. 1 is a front view showing an embodiment of the invention securing several notebooks and some writing or note taking items.

Referring now to FIGS. 1, 1*a* and 1*b*, the inventive journal band 10 is shown stretched horizontally around several notebooks in FIG. 1, with writing implements in the loops 18. FIG. 1*a* shows the back view, while FIG. 1*b* shows the journal band 10 arranged vertically. The inventive journal band 10 is stretched over individual or multiple stationary items keeping them together and organized such as: tablets, folders, files, papers, books, journals, etc. and provides instrument/pen holders loops.

Figure 2:
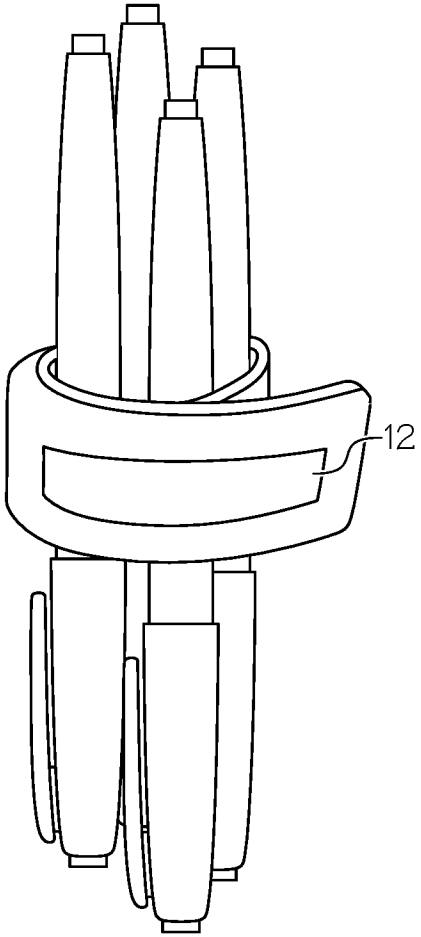
FIG. 2 shows the inventive journal band rolled up and secured to itself to become a compact portable pen/writing implement holder. The band 10 incorporates minimalistic strategically located attachment/closure hardware allowing the band to wrap or fold around itself and secured to itself transform the band into a compact pen holder. Easily packable and ready for service at a moment's notice.

FIG. 2 shows the inventive journal band 10 after it is taken off of the notebooks, and wrapped around and fastened to itself. A label 12 is arranged for easy viewing.

Figure 3:
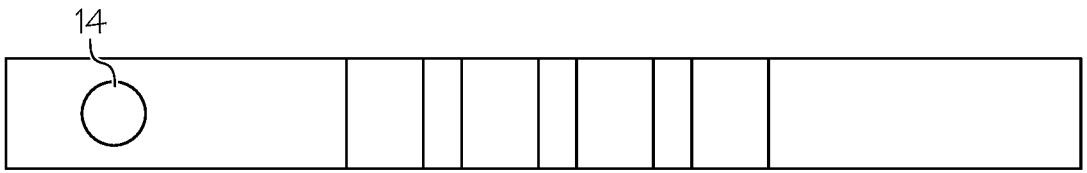
FIG. 3 shows a top view of one half of a snap.

FIG. 3 shows a top view of the band 10 showing the loop holders 18 and male stud snap 14.

Figure 4:
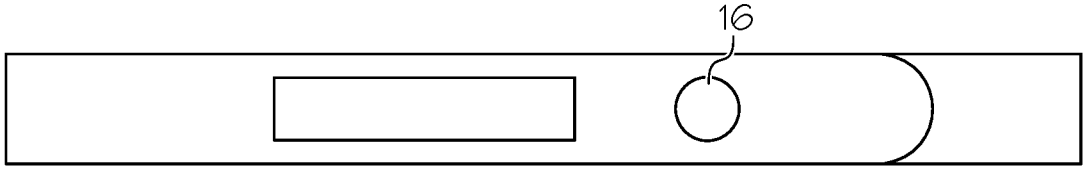
FIG. 4 shows a bottom view of the other half of the snap.

FIG. 4 shows a bottom view of the band 10 with the other half of the female socket snap 16 and label 12.

Figure 5:
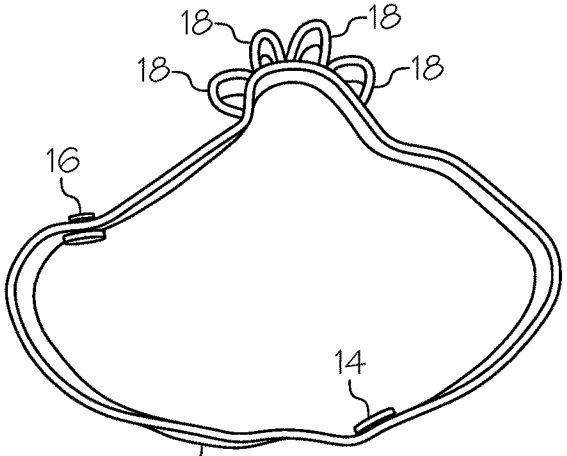
FIG. 5 shows a side view showing both snap portions and the writing implements loops.

FIG. 5 shows a side view of the band 10 showing the elastic loops 18, the label 12 and the two halves of the snap, 14 and 16.

Figure 6:
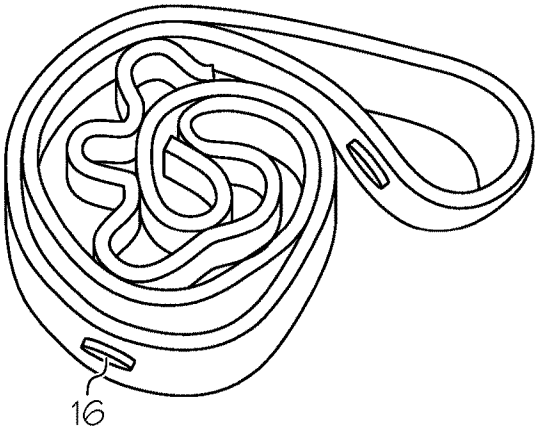
FIG. 6 shows the journal band rolled up and the snap fastened.

FIG. 6 shows the band 10 partially rolled up.

Figure 7:
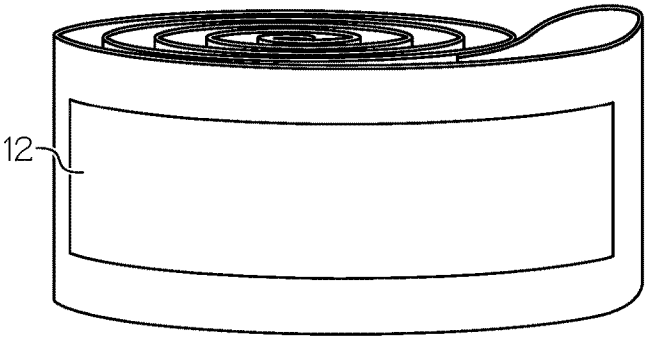
FIG. 7 shows an enlarged view of FIG. 6.

FIG. 7 shows the band 10 rolled up and fastened creating a desk friendly compact pen holder.

Figure 8:
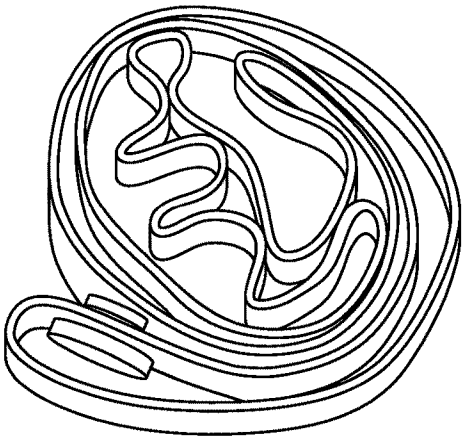
FIG. 8 shows the label.

FIG. 8 shows the label 12, positioned for easy viewing when the band 10 is rolled up and fastened.

Figure 13:
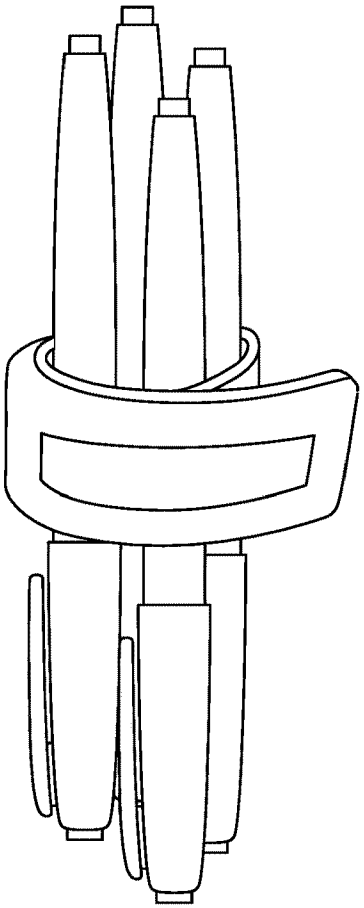
FIG. 13 shows a fully fastened snapped journal band.
Figure 10:
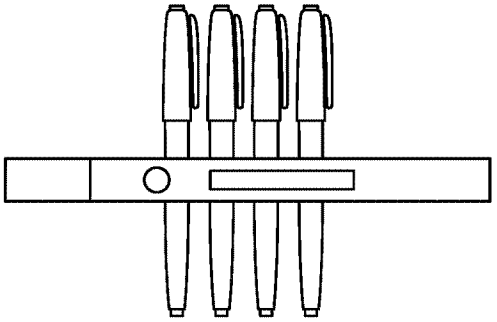
FIG. 10 shows a bottom view FIG. 9.
Figure 12:
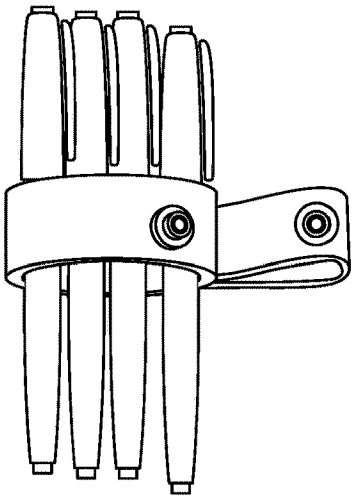
FIG. 12 shows the journal band wrapped around the writing implements just prior to fastening the snap.
Figure 9:
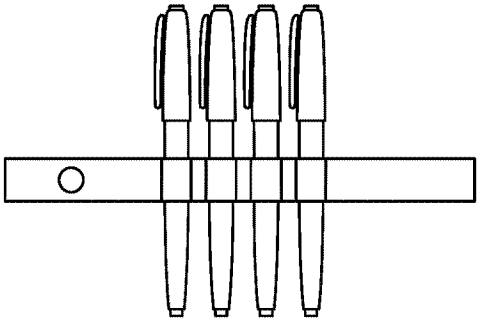
FIG. 9 shows a top view of the journal band with writing implements in the loops 18.
Figure 11:
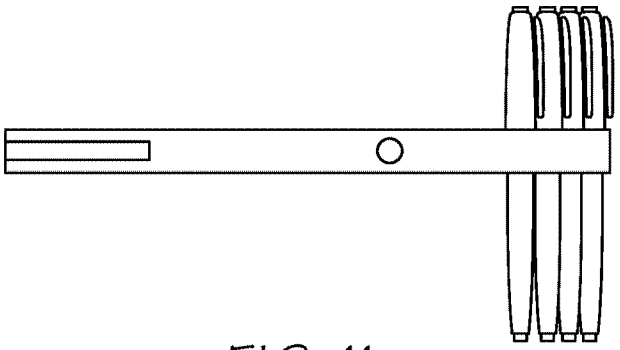
FIG. 11 shows another view of FIG. 9.

Referring now to FIGS. 9-13, the band 10 is shown with a variety of writing implements in loops 18, showing the front view (FIG. 9), the back view (FIG. 10), unrolled view (FIG. 11), partially rolled (FIG. 12) and fully rolled and fastened view (FIG. 13).

Figure 14:
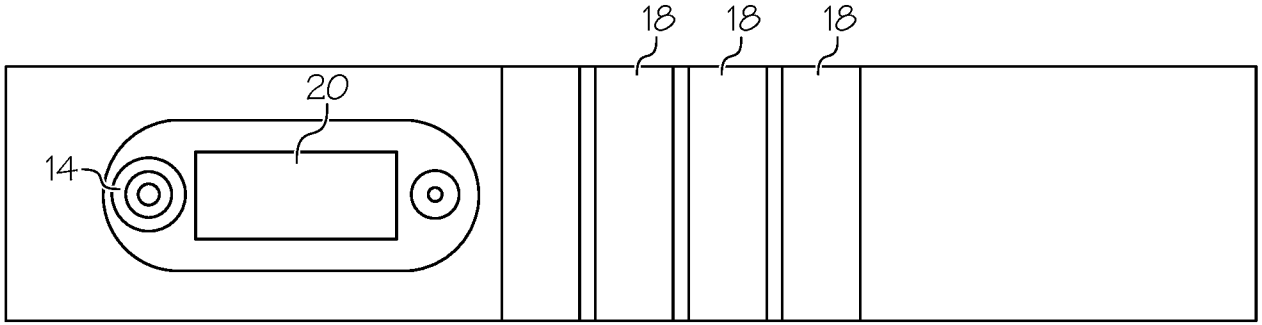
FIG. 14 shows a top view of another embodiment of the inventive journal band with a name plate.
Figure 15:
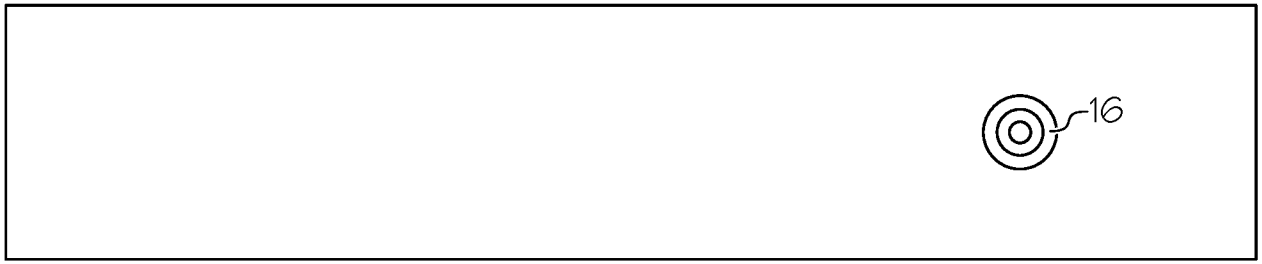
FIG. 15 shows a bottom view of the embodiment of FIG. 14.
Figure 17:
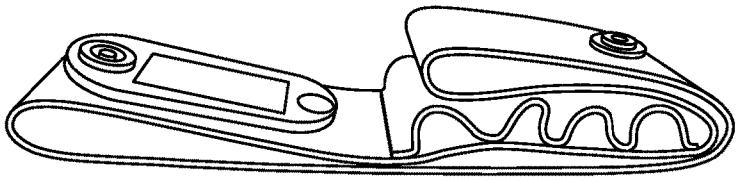
FIG. 17 shows a partially folded view of the embodiment of FIG. 14.
Figure 19:
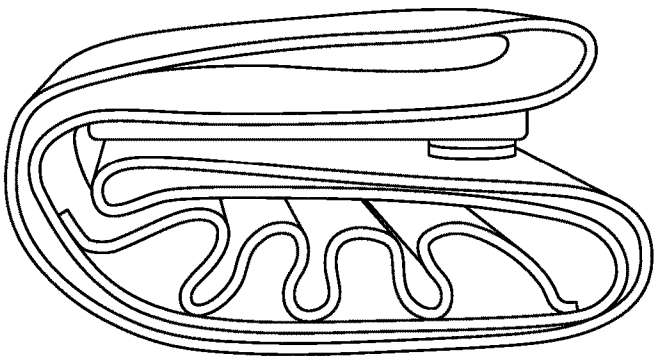
FIG. 19 shows the fully fastened embodiment of FIG. 14.
Figure 16:
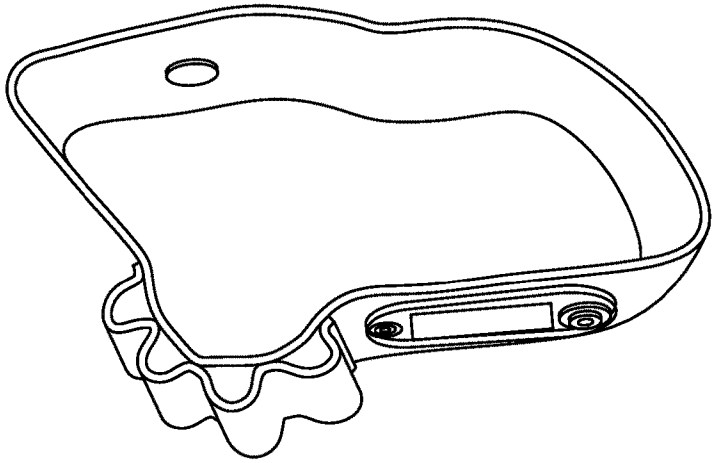
FIG. 16 shows a another view of the embodiment of FIG. 14.
Figure 18:
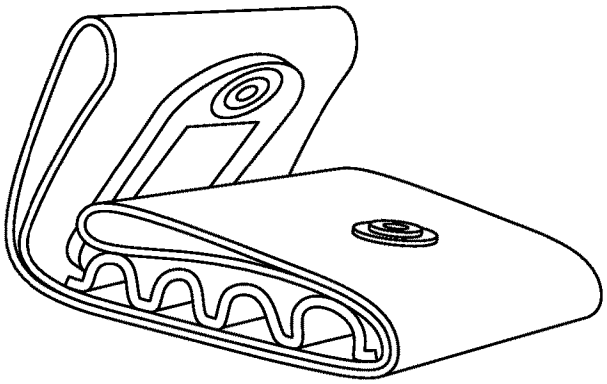
FIG. 18 shows a view of the embodiment of FIG. 14 just prior to snapping.
Figure 20:
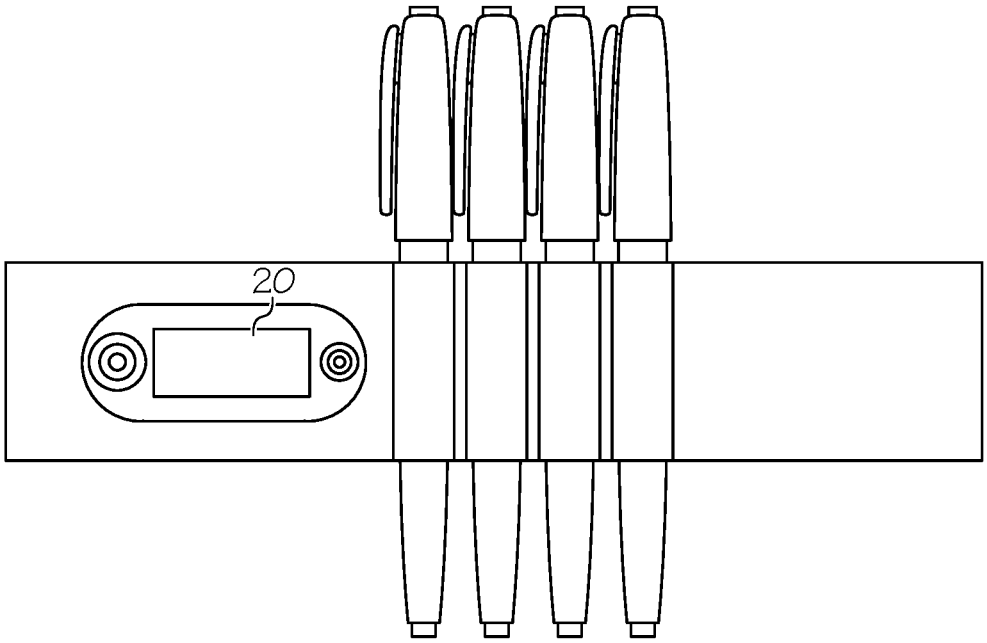
FIG. 20 shows a top view of the FIG. 14 embodiment with writing implements.
Figure 21:
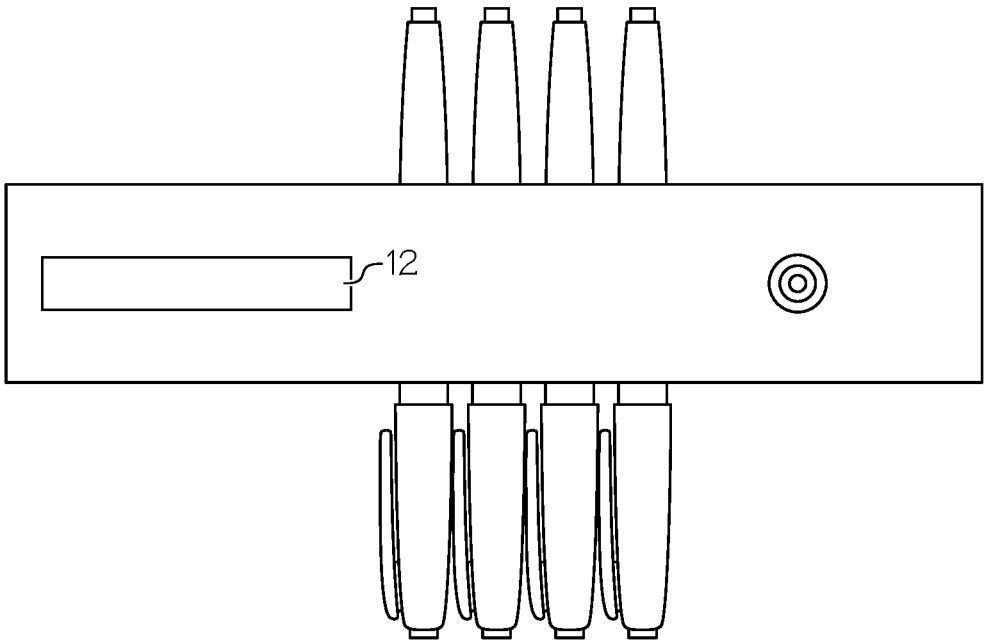
FIG. 21 shows a bottom view of FIG. 20.
Figure 23:
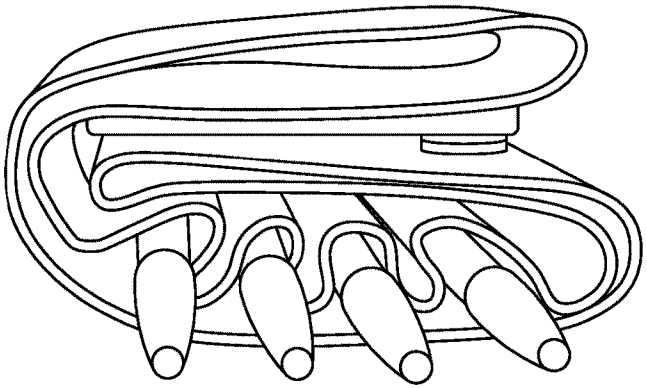
FIG. 23 shows a FIG. 20 just prior to fastening the snap.
Figure 22:
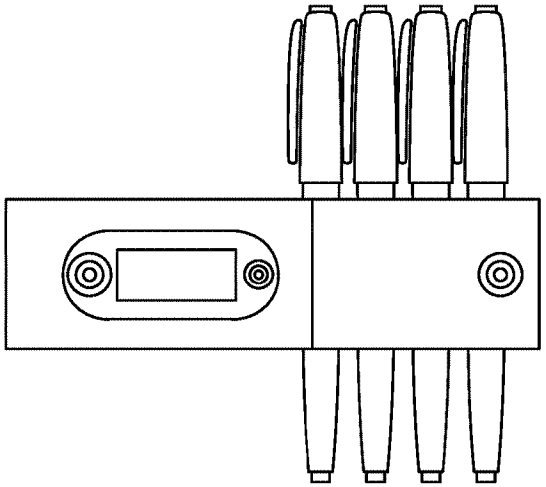
FIG. 22 shows a partially folded view of FIG. 20.
Figure 24:
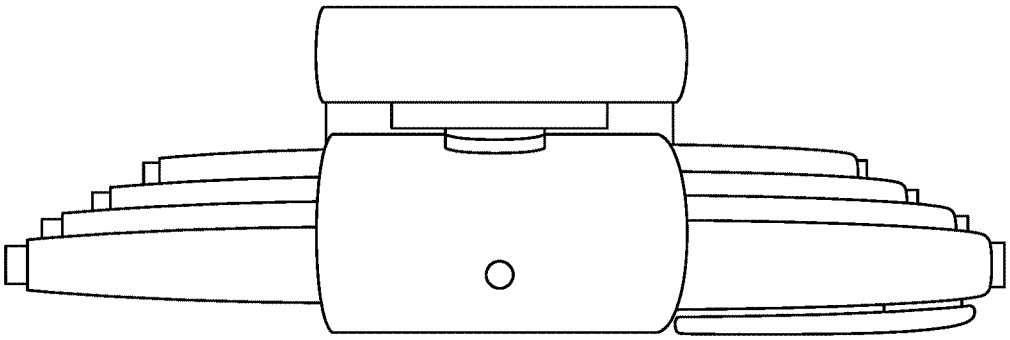
FIG. 24 shows a fully fastened view of FIG. 20.
Figure 26:
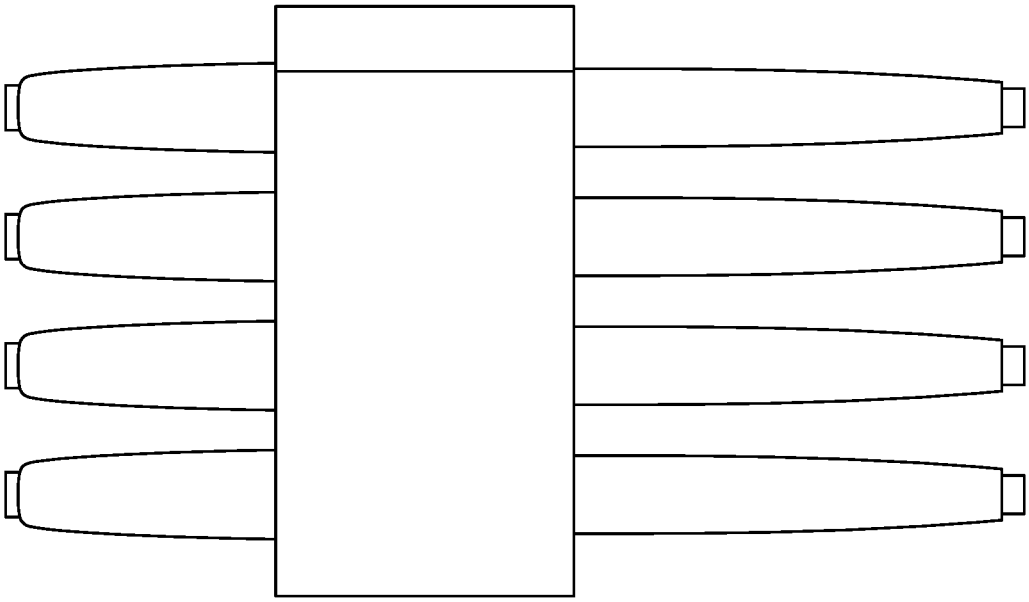
FIG. 26 shows a back view of FIG. 24.
Figure 25:
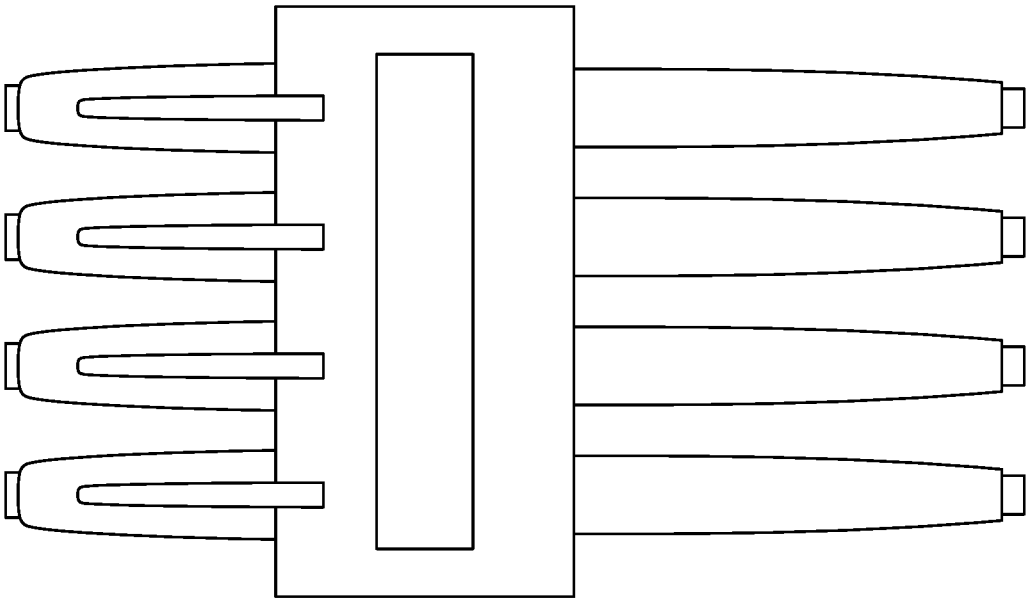
FIG. 25 shows a front view of FIG. 24.
Figure 27A:
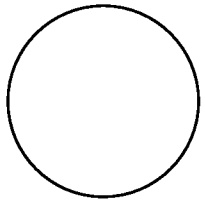
FIG. 27 shows alternative fasteners.
Figure 27B:
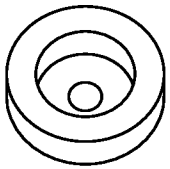
Figure 27C:
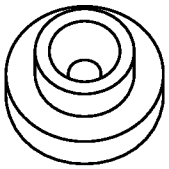
Figure 27D:
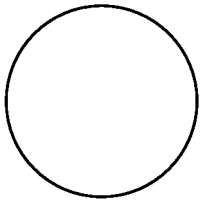
Figure 27E:
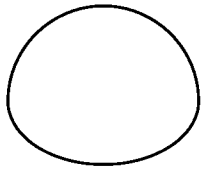
Figure 27F:
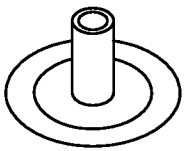
Figure 27G:
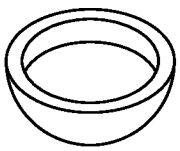
Figure 27H:
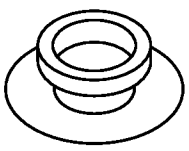

Referring now to FIGS. 14-19, an embodiment is shown with a name tag 20 instead of a label. FIG. 14 is a top view of band 10 showing loop holders 18 and stud snap 14 (left side of personalized name plate). Name plate 20 is an embellishment. The stud 16 in FIG. 15 is in the necessary location for securing after folding. FIG. 16 is a side view of band 10 showing loops 18, and both the stud & socket snaps and the label. FIG. 17 shows band 10 is folded over the loop holders 18 starting from opposite the stud side of band; covering the loop holders and positioning the socket snap over and on top of loop holders. FIG. 18 shows the label side of band can now be folded toward opposite side over the loop holders where it can align with socket snap and secure two together. FIG. 19 shows a side view of band in its folded and snapped state. Same view as FIG. 2 without any instruments in loop holders.

Referring now to FIGS. 20 through 26, the embodiment of FIG. 14 is shown with writing implements in holders 18.

FIG. 27 shows the current method of securing apparatus to itself uses standard KAM snaps. Additional stud and sockets can be added to a variety of misc. embellishment's or tools so they can be easily attached or removed.

Figure 28:
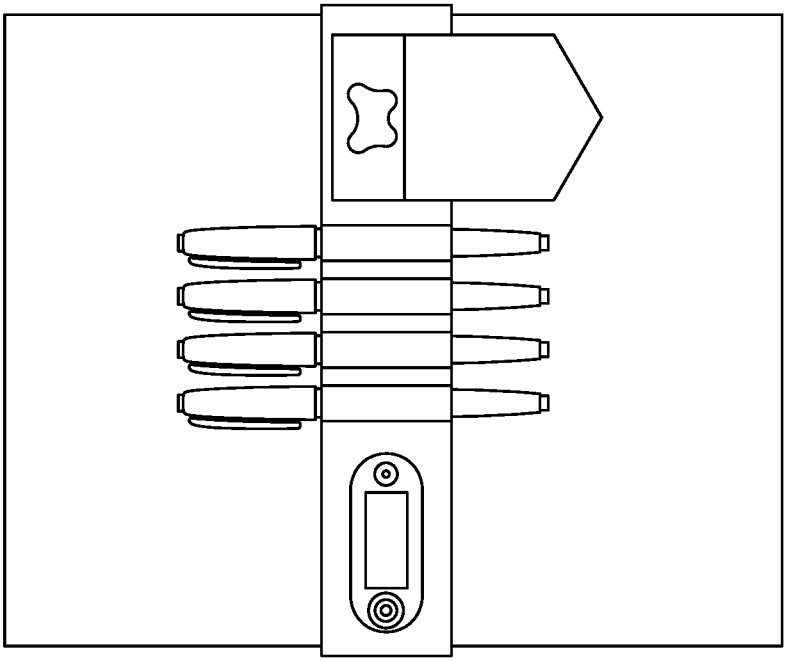
FIG. 28 shows a decorative item fastened to the journal band.

FIG. 28 shows apparatus that has additional embellishments added.

Figure 29:
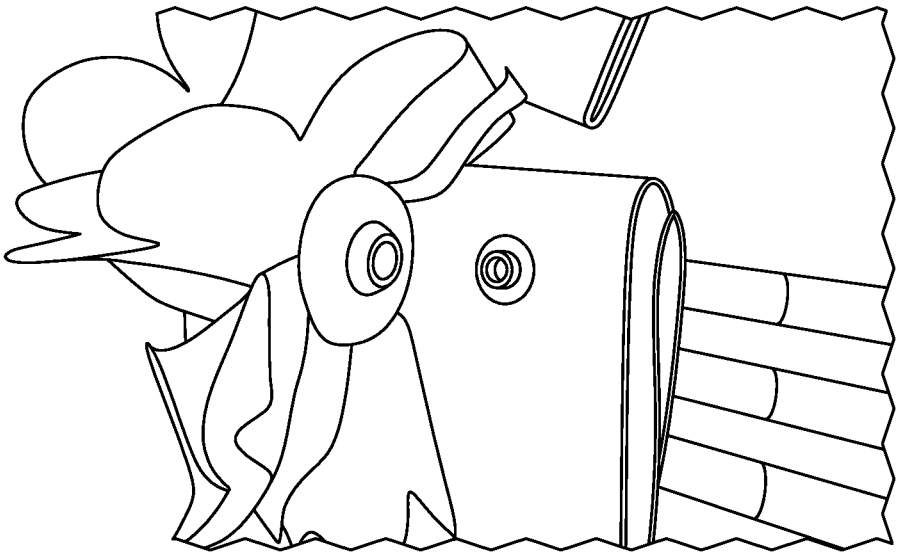
FIG. 29 shows a decorative item just prior to be fastened.

FIG. 29 shows an embellishment with a socket being attached to a stud on apparatus.

Figure 30:
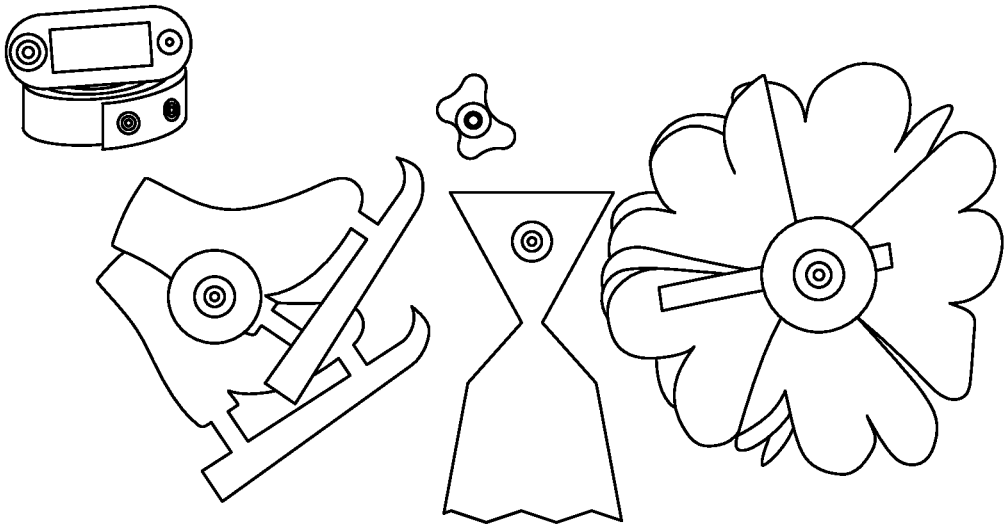
FIG. 30 shows additional decorative items.

FIG. 30 shows a variety of embellishments and their sockets.

Figure 31:
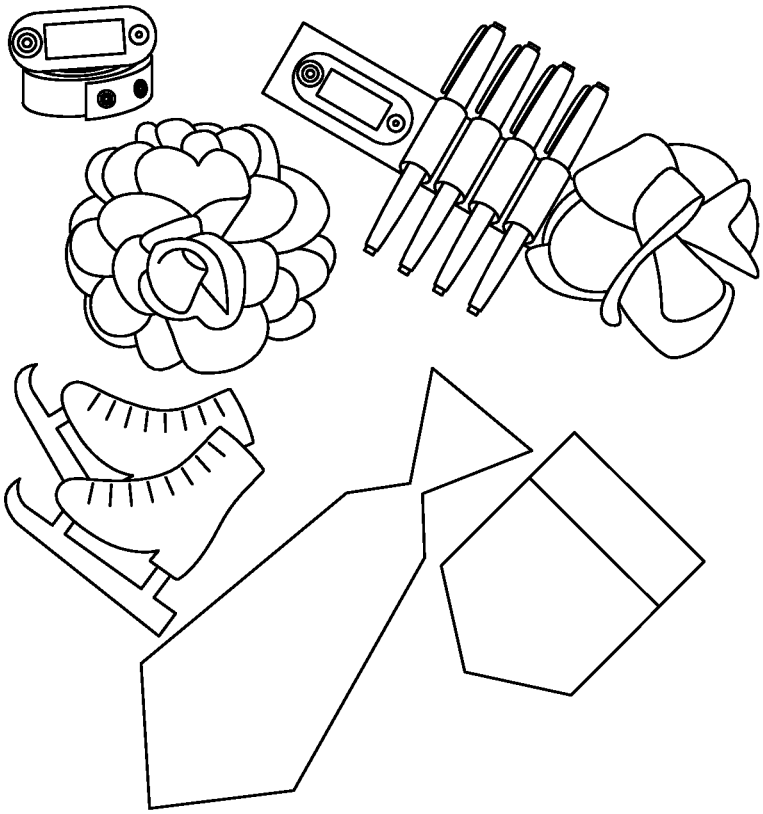
FIG. 31 shows additional decorative items.

FIG. 31 shows a front view of embellishments

Figure 32:
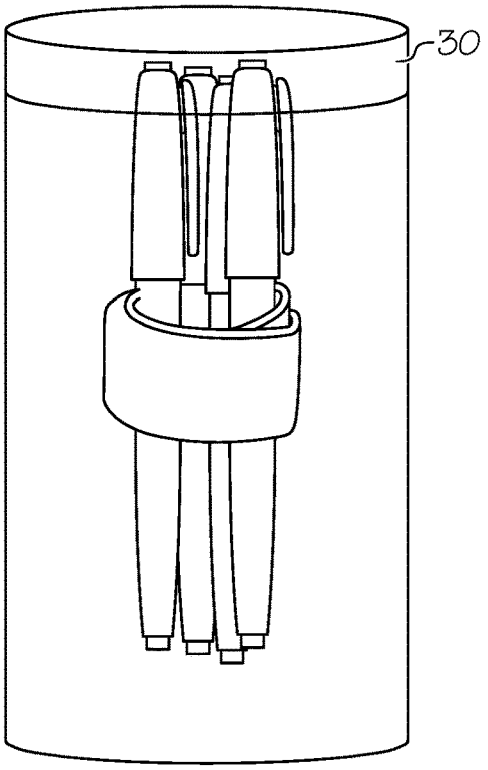

The invention could be sold with writing implements. FIG. 32 shows inventive band 10 and writing instruments packaged together in a cylinder shaped translucent container 30. The band 10 is wrapped around writing instruments making the pens and the apparatus viewable in cylinder.

Figure 33:
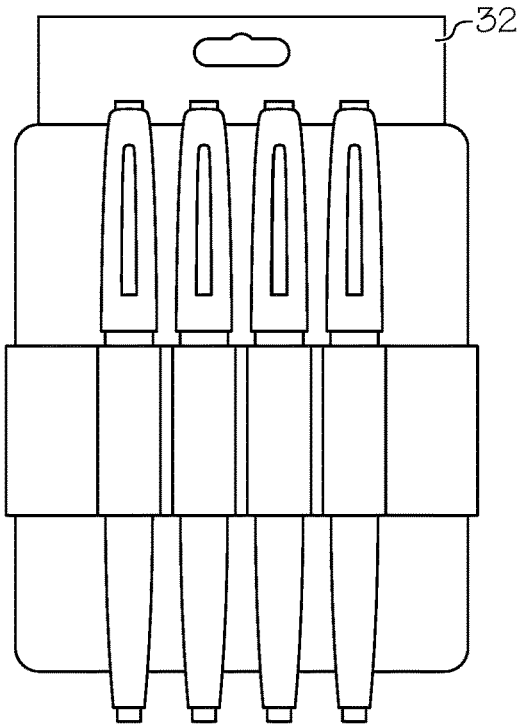
FIG. 33 shows packaging with the journal band partially outside the package.

FIG. 33 shows the band 10 and writing instruments packaged together in a clam shell 32. Pens or writing implements are secured behind the clam shell plastic the band 10 is allowed to stick out of the plastic, highlighting it.

A preferred construction method that creates a signature result (the apparatus will have a bowed appearance when not being stretched over something.) Stretch and secure elastic directly under the loop material. Secure the loop material onto the stretched under material vertically every ¾" as marked (see FIG. 35). Note: distance between measurements will vary based on characteristics of elastic being used. When stretched under material is released it will cause the loop material to bow outward creating the loops at consistent and desired width/height. This method can be used with one continuous piece of elastic or multiple material construction as long as the under material that the loop material is attached to is stretchable.

Figure 34:
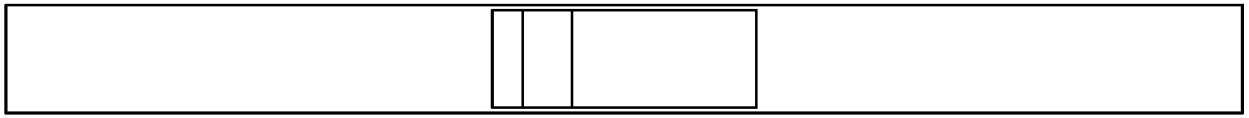
FIG. 34 shows a construction technique where the loop is attached when the base material is in a stretched position, with a different material for the base and loop.

FIG. 34 shows using multiple material construction in this image. The multi colored material is the primary band material. The solid color is for the loops set. The multi colored material in this example is 15" long and the loop material is 5".

Figure 35:
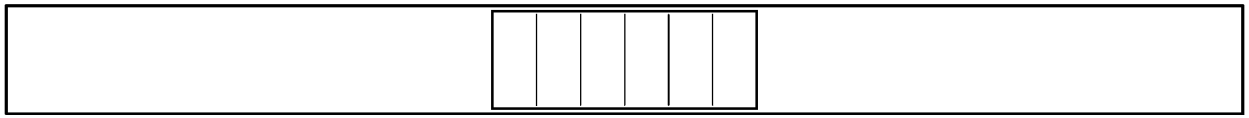
FIG. 35 shows a base material stretched.

FIG. 35 shows that the under material is stretched to near 100% but the loop material is not stretched. At this point the loop material is secured to the under material where marked.

Figure 36:
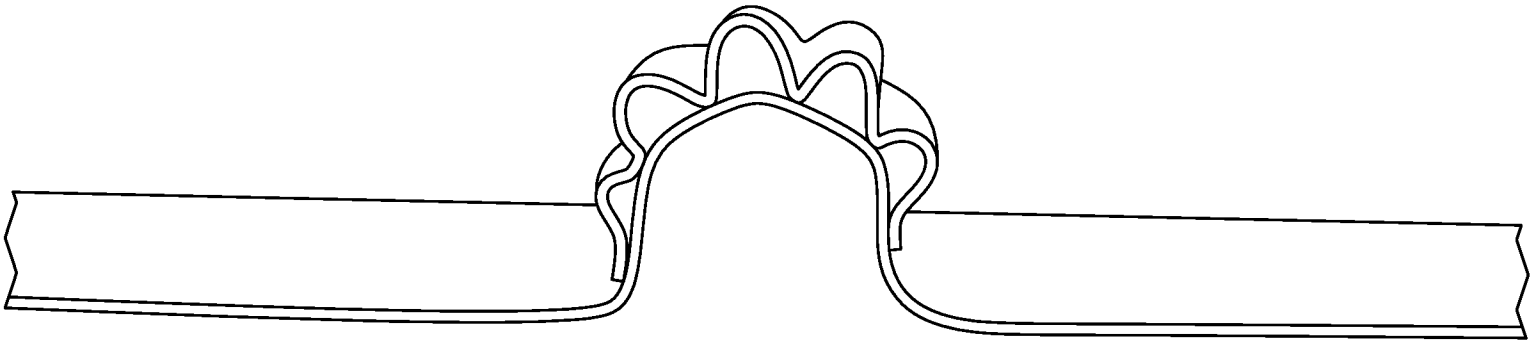
FIG. 36 shows the result, the loops are raised when the journal band is not being stretched.

FIG. 36 shows when under material is released from stretch—the loops are formed in the loop material. And the apparatus has a unique bow shape when not being stretched.

Figure 37:
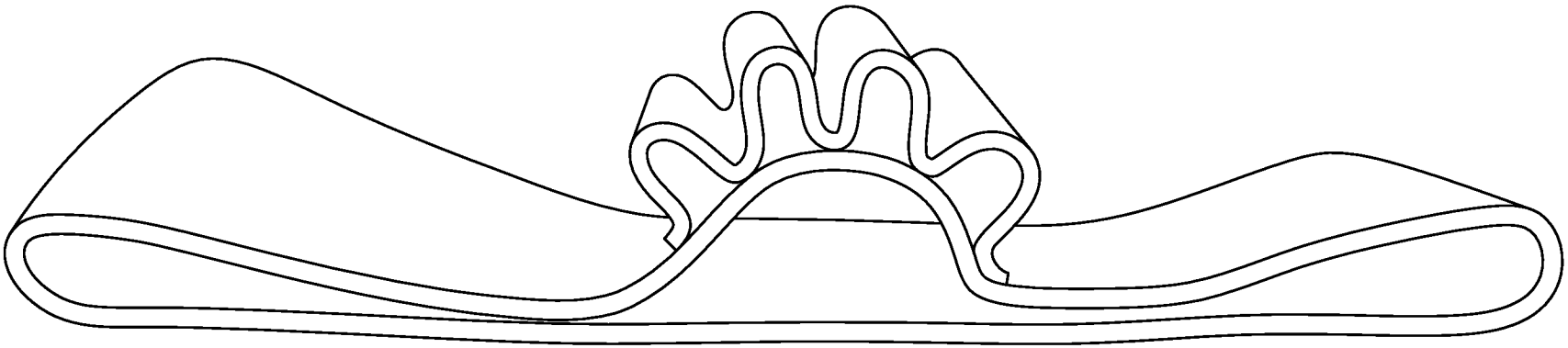
FIG. 37 shows the same base and loop material view of the other half of the snap.

FIG. 37 shows that in this example—one piece of material was used. But above theory of stretching was used to create the loops. Notice the unique resting shape of the apparatus. This shape is indicative of stretching construction method.

Figure 38:
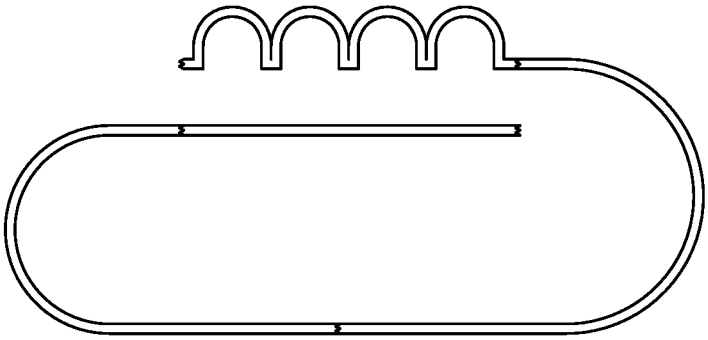
FIG. 38 shows how the inventive journal band can be made of one piece of material.
Figure 39:
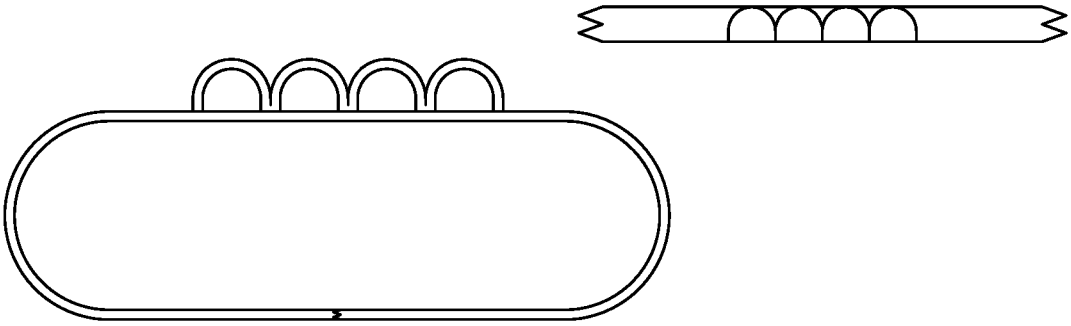
FIG. 39 shows how the inventive journal band can be made of two pieces of material.
Figure 40:
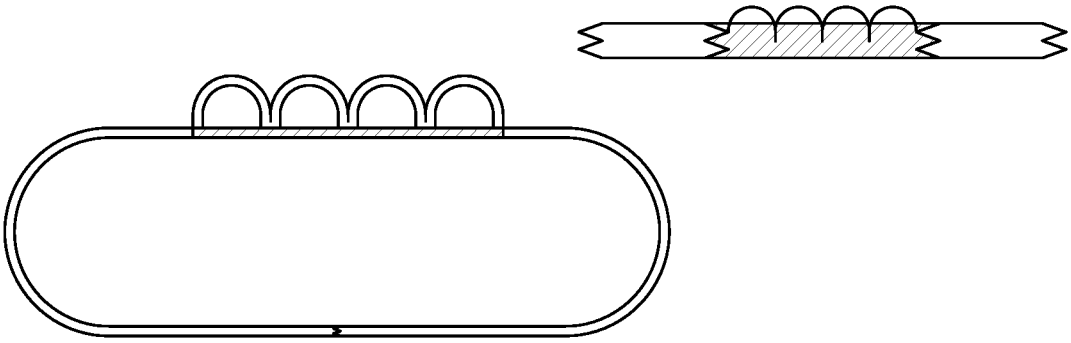
FIG. 40 shows how the inventive journal band can be made of three or more pieces of material.

FIGS. 38-40 show that the inventive band can be made from one piece of material, or two or three or more. The inventive band is made from any commercially available elastic material.

Figure 41:
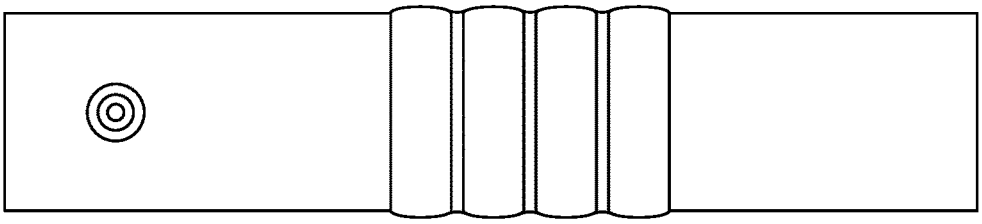
FIG. 41 shows a portion of a metal snap.
Figure 42:
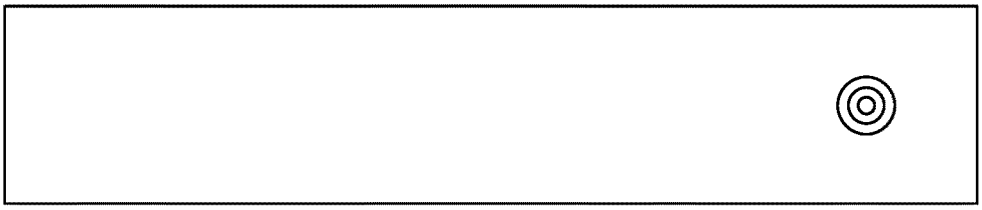
FIG. 42 shows the other half of the metal snap.
Figure 43:
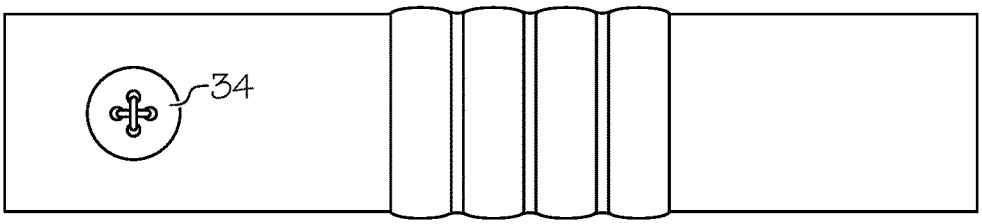
FIG. 43 shows a button fastener.
Figure 44:
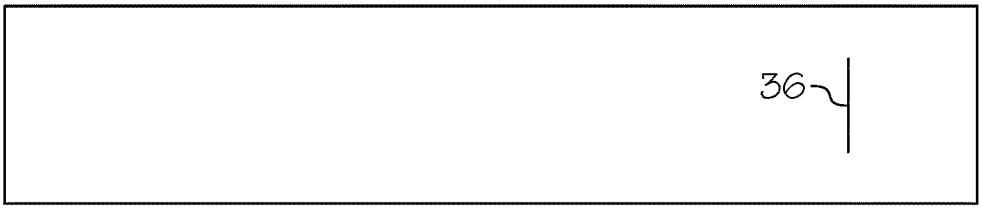

Many variations of closing hardware can be used besides KAM snaps. For example buttons, hook and loop (Velcro), metal snaps, etc. If apparatus is designed to wrap or fold onto itself using a device or some type of hardware, it is intended to fall within the scope of this invention. FIGS. 41 and 42 show metal snaps. FIGS. 43 and 44 show a button 34 and matching button hole 36.

Figure 45:
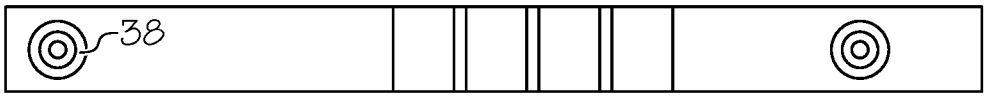
FIG. 45 shows a top view of an embodiment with additional fasteners for embellishments.
Figure 46:
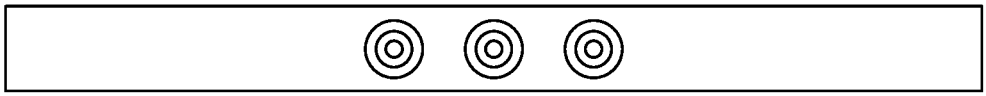
FIG. 46 shows a bottom view of FIG. 45.
Figure 47:
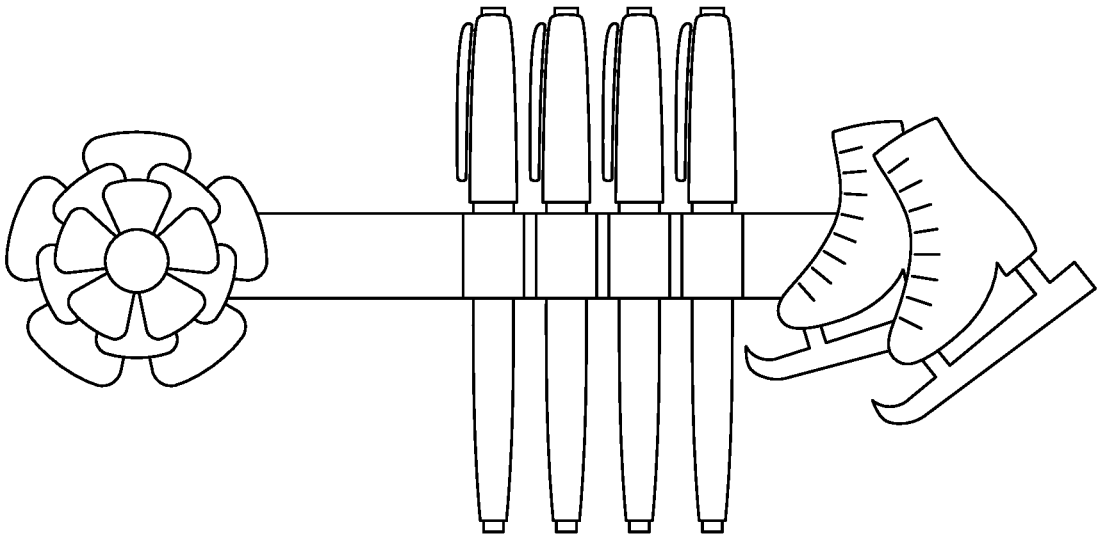
FIG. 47 shows several embellishments attached to the inventive journal band.
Figure 48:
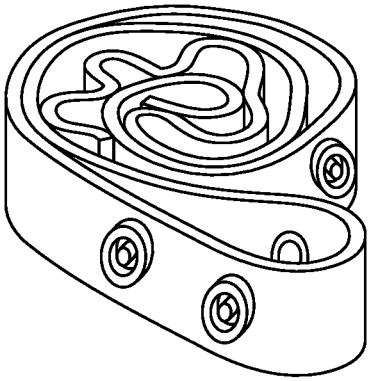
FIG. 48 shows a partially rolled up journal band prior to being fastened to itself.
Figure 49:
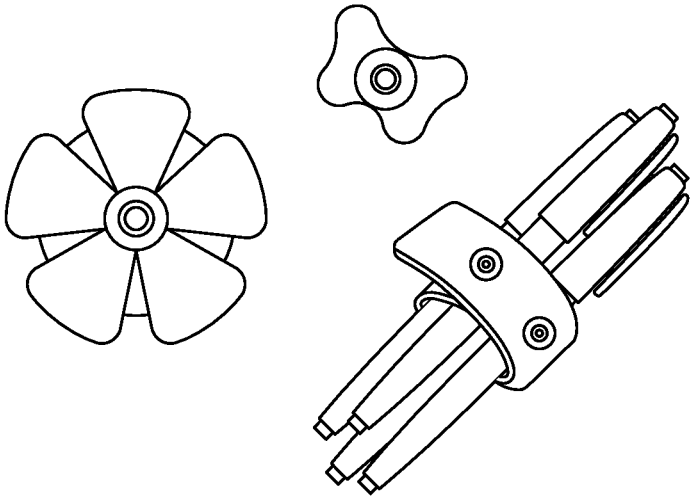
FIG. 49 shows a rolled up journal band with several embellishments which can be fastened to decorate the band.
Figure 50:
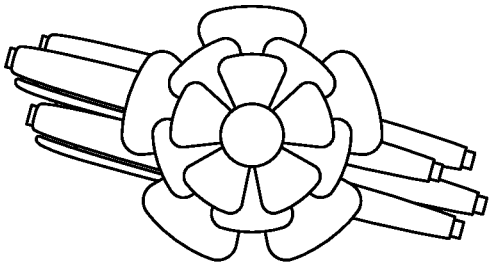
FIG. 50 shows FIG. 49 with an embellishment attached.

Attachable and removable embellishments and/or tools may also use other types of hardware besides those disclosed as examples herein. They too are intended to fall within the scope of the invention. FIG. 45 shows a top view of an additional snap 38 for attaching an embellishment. FIG. 46 shows the bottom view. FIG. 47 shows two embellishments attached to the band 10. FIG. 48 shows the partially rolled up band 10. FIG. 49 shows the fully rolled band with snap 38 ready for attaching an embellishment. FIG. 50 shows the embellishment attached to the snap 38.

Additional hardware can be added to accommodate multiple closing and attachability at various locations depending on desired effect or needs.

What is claimed is:

1. A stationery securing apparatus and writing instrument holder, comprising:

a band, at least a portion of which is elastic;

at least two writing instrument loops attached to the elastic band, and a male snap portion and a female snap portion attached to the band, configured and arranged so that when the band is not in use securing stationery, it can be folded or rolled up and the male snap portion and the female snap portion can be snapped together to form a compact writing instrument holder.

2. The stationery securing apparatus and writing instrument holder of claim 1 wherein the stationery is selected from the group consisting of tablets, notebooks, folders, files, papers, books, journals and any combination thereof.

3. The stationery securing apparatus and writing instrument holder of claim 1 further including a name label attached to the band.

4. The stationery securing apparatus and writing instrument holder of claim 1 further including a modular snap attachment selected from the group consisting of name labels, brand attachments, icon attachments, logo attachments, pocket attachments and decorative attachments, the modular snap attachment having a male or female snap portion to mate with the female or male snap portion on the band.

5. The stationery securing apparatus and writing instrument holder of claim 4 further including an additional male or female snap portion to permit the modular attachment to be attached to the additional male or female snap portion when the stationery securing apparatus and writing instrument holder is folded or rolled up and the male snap portion and the female snap portion are snapped together to form a compact writing instrument holder.

6. The stationery securing apparatus and writing instrument holder of claim 1 arranged horizontally around at one stationery item.

7. The stationery securing apparatus and writing instrument holder of claim 1 arranged vertically around at one stationery item.

8. The stationery securing apparatus and writing instrument holder of claim 7 wherein the stationery item is a book and the stationery securing apparatus and instrument holder functions as a bookmark.

9. The stationery securing apparatus and writing instrument holder of claim 1 wherein the male and female snap portions are configured and arranged so the stationery securing apparatus and writing instrument holder rolls or folds up to the right.

10. The stationery securing apparatus and writing instrument holder of claim 1 wherein the male and female snap portions are configured and arranged so the stationery securing apparatus and writing instrument holder rolls or folds up to the left.

11. The stationery securing apparatus and writing instrument holder of claim 1 further including a second set of male and female snap portions, to permit the stationery securing apparatus and writing instrument holder to be rolled or folded up in multiple user selected manners.

12. The stationery securing apparatus and writing instrument holder of claim 11, wherein the second set of male and female snap portions are differently colored than the male and female snap portions.

13. The stationery securing apparatus and writing instrument holder of claim 12, wherein the male and female snap portions and second set of male and female snap portions are configured and arranged to permit the stationery securing apparatus and writing instrument holder to be rolled or folded up either to the right or left.

14. The stationery securing apparatus and writing instrument holder of claim 1 wherein the at least two writing instrument loops have a top and bottom end, with the top end having a wider opening than the bottom end, for ease of insertion of a writing instrument in one of the at least two writing instrument loops.

15. The stationery securing apparatus and writing instrument holder of claim 1 wherein the at least two writing instrument loops are attached to the elastic band by sewing them to the elastic band.

16. The stationery securing apparatus and writing instrument holder of claim 1 wherein the at least two writing instrument loops are attached to the elastic band by including a writing instrument substrate having at least two slits and by weaving one end of the elastic band through the slits to form the at least two writing instrument loops.

17. A kit comprising:

the stationery securing apparatus and writing instrument holder of claim 1, with the band rolled or folded and the male and female snap portions snapped together, at least two writing instruments contained by the at least two writing instrument loops, and a transparent holder for holding the stationery securing apparatus and writing instrument holder.

18. A kit comprising:

the stationery securing apparatus and writing instrument holder of claim 1, at least two writing instruments contained by the at least two writing instrument loops, and a clam shell plastic package, with the writing instruments secured inside the clam shell package and the band extending outside and around the clam shell.

19. A stationery securing apparatus and writing instrument holder, comprising:

a band, at least a portion of which is elastic;

at least two writing instrument loops attached to the elastic band, and a male hook portion and a female loop portion attached to the band, configured and arranged so that when the band is not in use securing stationery, it can be folded or rolled up and the male hook portion and the female loop portion can be secured together to form a compact writing instrument holder.

20. A stationery securing apparatus and writing instrument holder, comprising:

a band, at least a portion of which is elastic;

at least two writing instrument loops attached to the elastic band, and and first and second securing sections configured and arranged on the band to be secured to each other, the first and second securing sections selected from the group consisting of male and female snap portions, hook and loop portions, and button and buttonhole portions.

21. A method of manufacturing a stationery securing apparatus and writing instrument holder, comprising the steps of:

providing a predetermined length of band material having first and second ends, at least a portion of the band material being is elastic;

stretching at least the portion of band material which is elastic;

attaching a piece of elastic loop material to the stretched band material, the elastic loop material having first and second ends, the first and second ends being secured to the band material;

making at least two writing instrument loops by securing the elastic loop material to the band material at predetermined intervals;

securing the first and second ends of the band material to each other;

attaching a male snap portion to the band, and attaching a female snap portion to the band, whereby when the stretched band with the attached elastic loop material is allowed to relax, the elastic loop material forms at least two writing instrument loops.

* * * * *